United States Patent [19]

Rodriquez

[11] Patent Number: 4,487,450

[45] Date of Patent: Dec. 11, 1984

[54] ARMCHAIR CONVERTIBLE INTO CHAISE LONGUE WITH SEPARATE HINGED BASE AND TILTING HEAD REST

[75] Inventor: Rodrigo Rodriquez, Carimate, Italy

[73] Assignee: Cassina SpA, Meda, Italy

[21] Appl. No.: 302,792

[22] Filed: Sep. 16, 1981

[30] Foreign Application Priority Data

Sep. 18, 1980 [IT] Italy ..... 24747 A/80

[51] Int. Cl.[3] ..... A47C 13/00

[52] U.S. Cl. ..... 297/111; 297/408; 297/433

[58] Field of Search ..... 297/111, 105, 429, 433, 297/408, 423

[56] References Cited

U.S. PATENT DOCUMENTS

| | | | |
|---|---|---|---|
| 840,348 | 1/1907 | Leonard | 297/408 X |
| 1,349,227 | 8/1920 | Shkor | 297/105 X |
| 2,150,478 | 3/1939 | Yerrick | 297/433 X |
| 2,467,638 | 4/1949 | Thomas | 297/111 |
| 2,697,480 | 12/1954 | DuBois | 297/408 |
| 2,865,434 | 12/1958 | Grenz | 297/408 X |
| 4,113,310 | 9/1978 | Kapanka | 297/408 |

FOREIGN PATENT DOCUMENTS

| | | | |
|---|---|---|---|
| 1033869 | 7/1958 | Fed. Rep. of Germany | 297/105 |
| 612856 | 8/1926 | France | 297/111 |

*Primary Examiner*—Francis K. Zugel

*Attorney, Agent, or Firm*—Karl F. Ross; Herbert Dubno

[57] ABSTRACT

An armchair is formed of four frame elements joined together. The central frame, comprising the seat, is hinged to the rear frame, which forms the back, at the top of which sits a head rest divided into two independent parts able to assume two secure positions, upright or turned back. The central frame is linked at the front with a lower frame that serves as a base when the chair is closed and as a footrest when turned up in front to convert the chair into a chaise longue.

4 Claims, 7 Drawing Figures

A
B

ARMCHAIR CONVERTIBLE INTO CHAISE LONGUE WITH SEPARATE HINGED BASE AND TILTING HEAD REST

FIELD OF THE INVENTION

This invention is an armchair convertible into a chaise longue and made up of four metal frames hinged together to assume various positions and facilitate its conversion.

BACKGROUND OF THE INVENTION

Many types of armchairs can be put into two positions—(1) that of an ordinary chair with arms, seat, and back normally in place for a comfortable sitting position and (2) a chaise longue intended to give the user complete support in a generally horizontal position with an attached headrest and legrest, which can be connected to the armchair frame.

Such convertible chairs have the inconvenience fo comprising a supporting structure of legs or feet forming the base, on which the chair rests when it is "closed" (normal position) or "open" (stretched out), while the added elements, such as the headrest and the legrest, are unused in the closed chair and brought into an effective position only when it is open. This implies either a considerable weight for the whole chair because of the fixed structure of the base, complicated mechanisms for the concealment or removal of the legrest, or means for the flexion of the various parts to allow for the stretched-out position.

OBJECT OF THE INVENTION

The object of the invention is thus that of eliminating such inconveniences, keeping in mind that a convertible chair should be light, of simple construction, without complex mechanisms, and of easy conversion.

SUMMARY OF THE INVENTION

This object is realized with the invention of a chair, in which the usual mechanisms are eliminated and every part of which justifies its use, permitting it to be noticeably closer to the floor in the stretched-out position and to rest on the floor with the forward end tucked underneath.

The chair convertible into a chaise longue is composed of a metal structure divided into four frames, of which the central one forms the seat, the rear one forms the back, the upper one forms the headrest, subdivided into two separate parts, and the lower one forms the base, these elements being connected by hinges and the lower, movable one attached to the front end of the central element for assuming the turned-under position to support the chair in the closed position or, on the other hand, that of being swung out forward to form the legrest. The support of the chair in the stretched-out position is shared by the back end of the central frame and the outwardly swinging front end of the lower frame, the two parts of the upper frame being able to turn independently of each other on the upper end of the back frame so that each may assume either of two fixed positions—upright or turned back.

Those elements of the central and lower frames have their adjoining parts in a generally vertical position, their ends being joined by hinges in a horizontal axis so that when the chair is closed they are substantially in alignment, while when the chair is open they keep the seat and the legrest at an angle to the vertical. As mentioned, the two parts of the upper frame forming two separate and independent headrests may be rotated with respect to the top of the back element, kept in either of the two extreme positions by springs secured at each end and attached in variable equilibrium.

When the chair is stretched out it rests, as noted, on the front and back ends of the seat and the legrest, which makes it noticeably lower than the closed chair, adding to its stability and the user's comfort.

BRIEF DESCRIPTION OF THE DRAWING

These and other characteristics will be evident from the following detailed description of an embodiment the chair convertible into a chaise longue according to this invention illustrated in the appended drawing, in which.

SPECIFIC DESCRIPTION

Figure 1:
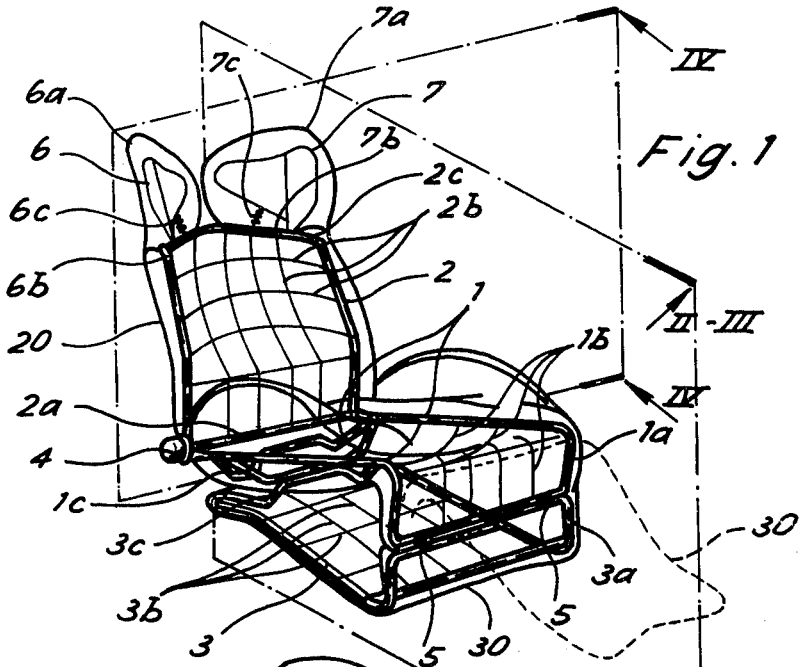
FIG. 1 shows the structure of the whole chair, with the metal frame seen in outline.

With reference to FIGS. 1 through 4, the invention comprises a metal structure formed by a tubular framework divided into four elementary frames, whose central element 1 forms (see FIGS. 1, 2, 5) the seat, whose rear element 2 forms the back, whose lower element 3 constitutes the base when the chair is closed and the legrest when it is open, as indicated by dashed lines in FIG. 1, and whose upper element 6, 7 forms the two-part headrest. Element 1, making up the seat, is curved downward at the front, with the bent part 1*a* on top of the part 3*a* of the lower element 3, while the same piece of frame 1 is connected with the back 2 by an axle 2*a* and cap 4 to permit various positions of inclination of the back. These elements of tubular frame make up the weight-bearing structure and, for the support of the covering, are completed by webbing of metal or other material—1*b*, 2*b*, and 3*b*, respectively—each part anatomically shaped to conform to the corresponding contours of the human body.

The front part 3*a* of frame 3 is connected with the front part 1 by hinge 5 or a horizontal axis, and the rear part of frame 3 has a tubular adjunct turned upwards 3*c* on which rests a tubular appendage 1*c* fixed to the rear of central frame 1.

Figures 3, 5, 7:
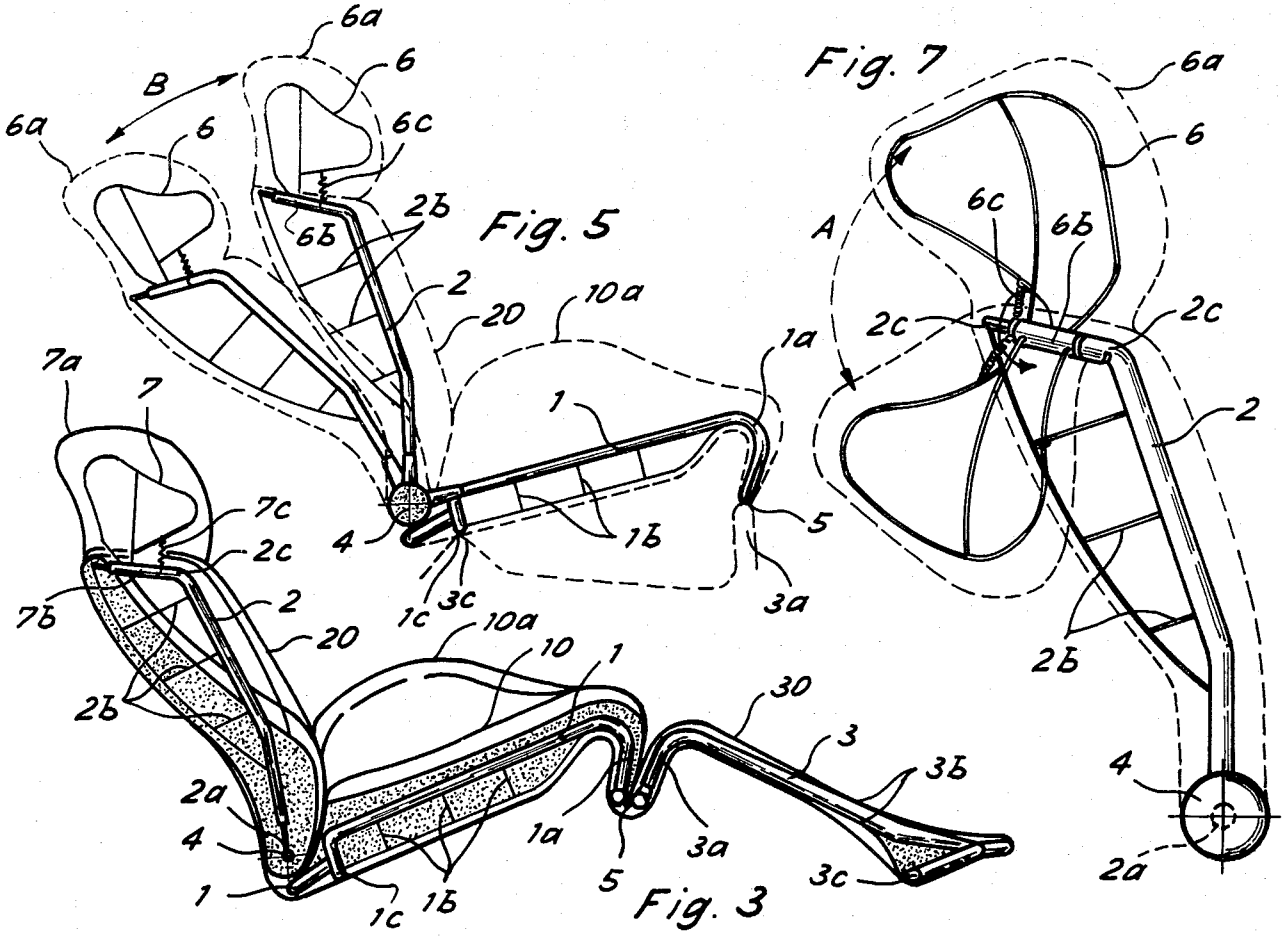
FIG. 3 shows the same section as FIG. 2 but with the chair open.
FIG. 5 shows in outline the details of the inclining back.
FIGS. 6 and 7, respectively, show the structure and movement of the headrest.
Figure 4:
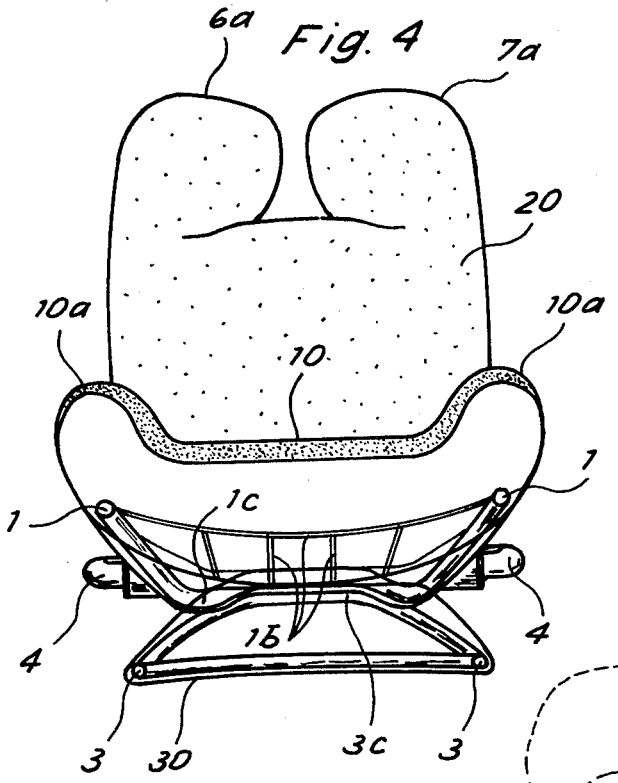
FIG. 4 shows the chair of FIG. 1 in transverse section on a vertical plane indicated by IV—IV in FIG. 1 (closed chair).
Figure 6:
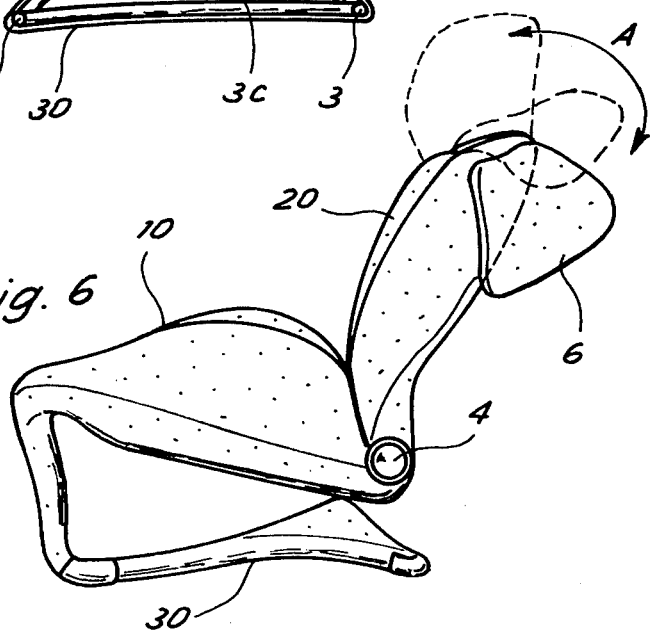

On the upper part 2*c* of the rear frame 2 are attached the two molded elements 6, 7, which make up the headrest in two separate and distinct parts, 6*a*–7*a*, as seen in FIGS. 1 and 4, independent of each other and capable of assuming two fixed positions (see FIG. 6), one turned up, as indicated by dashed lines in FIG. 6 and by solid lines FIGS. 1 through 4, and the other turned back as seen in FIGS. 6 and 7.

The separate elements 6, 7 of the headrest 6*a*, 7*a* are distinct from each other and are bent back, and they move on hinges on the arm 2*c* of frame 2 (see FIG. 7) by means of a clasp formed by a tubular rod for each—6*b*, 7*b*, respectively—which turns on rod 2*c* of element 2.

Each of the two parts 6a, 7a is kept stable in the two positions of erect and turned back by a hinge or other device 6c, 7c placed between each of the elements 6, 7 and the arm 2c, so as to lie beyond a point of unstable equilibrium and maintain the two opposite positions with a certain elasticity.

FIGS. 6 and 7 show the two positions of one of the two parts of the headrest, here indicated with 6a, the other acting similarly.

The tipping up or down of each part of the headrest occurs in either direction marked by the arrows A as the user chooses.

FIG. 5 shows the details of the frame in regard to the inclination (arrow at B) of the back (2) with its headrests around joint 4, which may be of any possible type in a determinable or other position.

The entire structure of the chair is covered with padding and overlaid with upholstery of any kind to form the chair 10 with arms 10a firmly attached back 20, and legrest 3. The headrest—in two separate parts, either of which may constitute a single headrest—has sufficient padding (6a–7a), and each part is individually covered.

Figure 2:
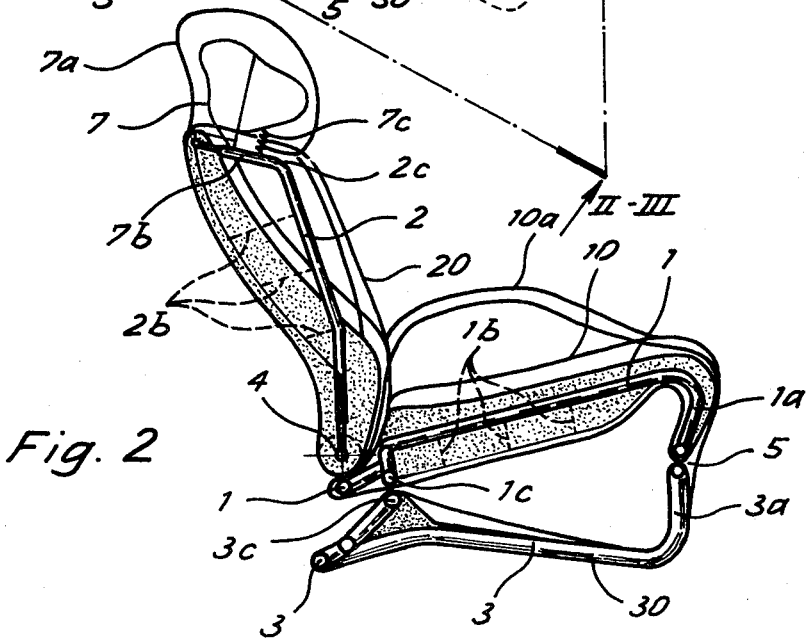
FIG. 2 shows a midsection of the closed chair in vertical axis indicated in FIG. 1 by II—II.

With particular reference to FIGS. 1, 2, and 3, note that according to the invention, the chair can assume either of two positions: one, which can be called "closed," is represented in FIGS. 1 and 2, and the other, "open," is represented in FIG. 3. In the closed position the element of the central frame 1 rests on the element of the lower frame 3, which is bent under it in that position to form the base of the chair. The central frame is supported by the hinge 5 of the front edge and by its position over the arms 1c, 3c of the rear edge.

FIG. 3 shows the device in the stretched-out position, and it can be seen that such position is obtained by rotating the lower part 3 with its padding 30 covering hinge 5 so that the front parts 1a of frame 1 and 3a of frame 3 rest against each other, forming a certain angle with the vertical. In this position the chair rests on the floor, on the rear end of the central frame 1 and the adjunct or projection 3c of frame 3, while what was the supporting part on the floor with the chair closed becomes the legrest in the chaise-longue position, as may be clearly seen in FIG. 3 and as indicated by dashed lines in FIG. 1.

Whatever position the chair is in, it is in any case possible to incline the entire back 20 at various angles and, besides, to turn back or keep upright one or the other—or both—of the headrests 6, 7 as the user pleases.

It should be understood that many variants in type of construction, particularly regarding the padding and covering of the chair as devised, as well as the types and placement of hinges and joints, can be employed without going outside the limits of the present invention.

I claim:

1. A chair convertible from a seating unit into a chaise longue unit comprising:

a central frame adapted to form a seat and provided with a front end member;

a lower frame hinged to said front end member and swingable between an outwardly swung position in which said lower frame forms a foot rest and extends forwardly of said central frame and a position wherein said lower frame underlies said central frame and forms a base, entirely supporting said central frame and the entire seating unit;

a back-rest frame hinged to said central frame at a rear member thereof and defining a back rest angularly adjustable with respect to said central frame; and a two-element upper frame forming a head rest, each of the elements of said upper frame being separately pivotable on said back-rest frame between rearwardly swung stable positions and upwardly swung stable positions.

2. The chair as defined in claim 1 wherein said central frame has a downwardly turned front portion formed with said front member and lying substantially vertically and said lower frame has, in a position in which it forms said base for said seating unit, an upwardly turned rear portion substantially coplanarpwith said front portion of said central frame and hinged thereto at said front end member, said portions each being inclined to the vertical when said lower frame is swung outwardly to form said leg rest when said chair constitutes said chaise longue unit.

3. The chair defined in claim 2, further comprising respective springs engaging each of said elements for yieldably retaining same in the respective stable position thereof.

4. The chair defined in claim 3 wherein each of said frames is provided with a covering in anatomical form to engage the respective portion of a human body utilizing said chair.

* * * * *